US007497363B2

(12) United States Patent
Ronconi

(10) Patent No.: US 7,497,363 B2
(45) Date of Patent: Mar. 3, 2009

(54) PNEUMATIC FIXING MACHINE

(75) Inventor: Marco Ronconi, Bologna (IT)

(73) Assignee: Fasco S.p.A., Cadriano di Granarolo Emilia (IT)

( * ) Notice: Subject to any disclaimer, the term of this patent is extended or adjusted under 35 U.S.C. 154(b) by 0 days.

(21) Appl. No.: 10/581,150

(22) PCT Filed: Dec. 10, 2004

(86) PCT No.: PCT/IB2004/004082

§ 371 (c)(1),
(2), (4) Date: May 31, 2006

(87) PCT Pub. No.: WO2005/056242

PCT Pub. Date: Jun. 23, 2005

(65) Prior Publication Data

US 2007/0119899 A1 May 31, 2007

(30) Foreign Application Priority Data

Dec. 10, 2003 (IT) ..... BO2003A0740

(51) Int. Cl.
*B25C 1/04* (2006.01)

(52) U.S. Cl. ..... 227/8; 227/130; 91/307

(58) Field of Classification Search ..... 227/8, 227/130, 131; 91/236, 274, 321
See application file for complete search history.

(56) References Cited

U.S. PATENT DOCUMENTS 3,278,103 A 10/1966 Juilfs et al.
3,278,104 A * 10/1966 Becht et al. ..... 227/130
3,477,629 A * 11/1969 Becht ..... 227/130
3,547,003 A * 12/1970 Ramspeck ..... 91/252
3,638,532 A 2/1972 Novak
4,915,013 A * 4/1990 Moraht et al. ..... 91/307
5,370,037 A * 12/1994 Bauer et al. ..... 91/236
5,865,360 A * 2/1999 White ..... 227/130

FOREIGN PATENT DOCUMENTS

EP 0 774 327 A1 5/1997

* cited by examiner

*Primary Examiner*—Rinaldi I. Rada
*Assistant Examiner*—Nathaniel Chukwurah
(74) *Attorney, Agent, or Firm*—William J. Sapone; Coleman Sudol Sapone P.C.

(57) ABSTRACT

A pneumatic fixing machine has a piston (30) sliding within a cylinder (33), a first valve (5) movable between opening (L) and closing (D) positions, in correspondence of which the first valve connects an inlet portion (33*a*) of the cylinder (33) with either a feed of pressurized fluid or with an external outlet, respectively. A second valve (2) is operated by a trigger (7), the second valve being movable between an occlusion position (M) and a passage position (L) to either connect a first duct (9) and a base portion (5*a*) of the first valve (5) with the feed of pressurized fluid or with an external outlet. The machine (1) has a third valve (3) movable between a position of obstruction (N) and a crossing position (Q) to either cut off or to open a flow connection between the duct (9) and the first valve means (5), respectively, and a fourth valve (4) operated by the trigger (7), the fourth valve being movable between a block position (S) and a transit position (T), to either obstruct flow or allow free flow between the cylinder (33) and the third valve (3).

15 Claims, 6 Drawing Sheets

PNEUMATIC FIXING MACHINE

TECHNICAL FIELD

The present invention relates to the technical field of the portable pneumatic fixing machines, such as riveting machines, staplers, and particularly it refers to a pneumatic fixing machine provided for a manual use and able to operate in single hit or in automatic modality with repeated hits.

BACKGROUND ART

There are known machines as staplers e/o riveting compressed air machines provided with valves and control and regulation means allowing the single hit or automatic repetition operation or the release of a single fixing mean, for instance a metallic staple, a pin, a nail, etc., or the release of a plurality of such fixing means in sequence, with different timing.

The actuating of the two different modalities is generally obtained by partially or completely, up the stop, pressing the trigger of the utensil or pressing two separate triggers or pushers.

Such trigger or pusher, in fact, subsequently crushes two separate command pivots placed side by side, that act on respective pneumatic valves.

Typically, partially pressing the trigger, is obtained the single hit operating, and the automating working pressing it to the stop of the stroke.

A disadvantage of such type of operation consists in the excessive sensibility and attention required to the operator for pressing the trigger, in order to avoid to unintentionally and unawares operate the automatic operation rather than the single hit.

They are also known staplers machines in which the trigger commands only the automatic operation of the machine that can be inhibited to have the single hit through the operation of a pusher or button, that it operates an opportune pneumatic circuit.

In this case, the disadvantage resides in the discomfort of employment of the machine, because the operator is forced, to get the single hit, to press the trigger with the index and contemporarily the button with the thumb of the same hand, by realizing a non optimal handling and, therefore, inadequate firm and sure of the utensil.

In the known stapler machines, the fixing means are hammered in the piece to be worked through a beating blade, that is powered by an compressed air piston.

The piston is brought then in the initial position through the opening e/o closing of opportune valves or other pneumatic organs, typically distributors or exchangers automatically or manually commuted.

A drawback of such known machines consists in their structural and constructive complexity, that comprises numerous parts and components, resulting therefore expensive to build and to assemble.

DISCLOSURE OF THE INVENTION

An object of the present invention is to propose a pneumatic fixing machine to operate in both single or automatic repeated high frequency hit modality, that is compact and having a relatively simple structure, with a small number of components, therefore economic to realize and to assemble.

Other object is to propose a machine having sure and reliable operation, simple to be used also by a unskilled operator, reducing the risk of an unintentional actuating of the automatic modality at minimum.

Further object is to propose a fixing machine that allows the operator a firm and sure, correct and comfortable handling from the ergonomic point of view.

The above mentioned objects are achieved in accord with the content of the claims.

BRIEF DESCRIPTION OF THE DRAWINGS

The characteristics of the present invention are underlined in the following with particular reference to the enclosed drawings, in which.

Figure 1:
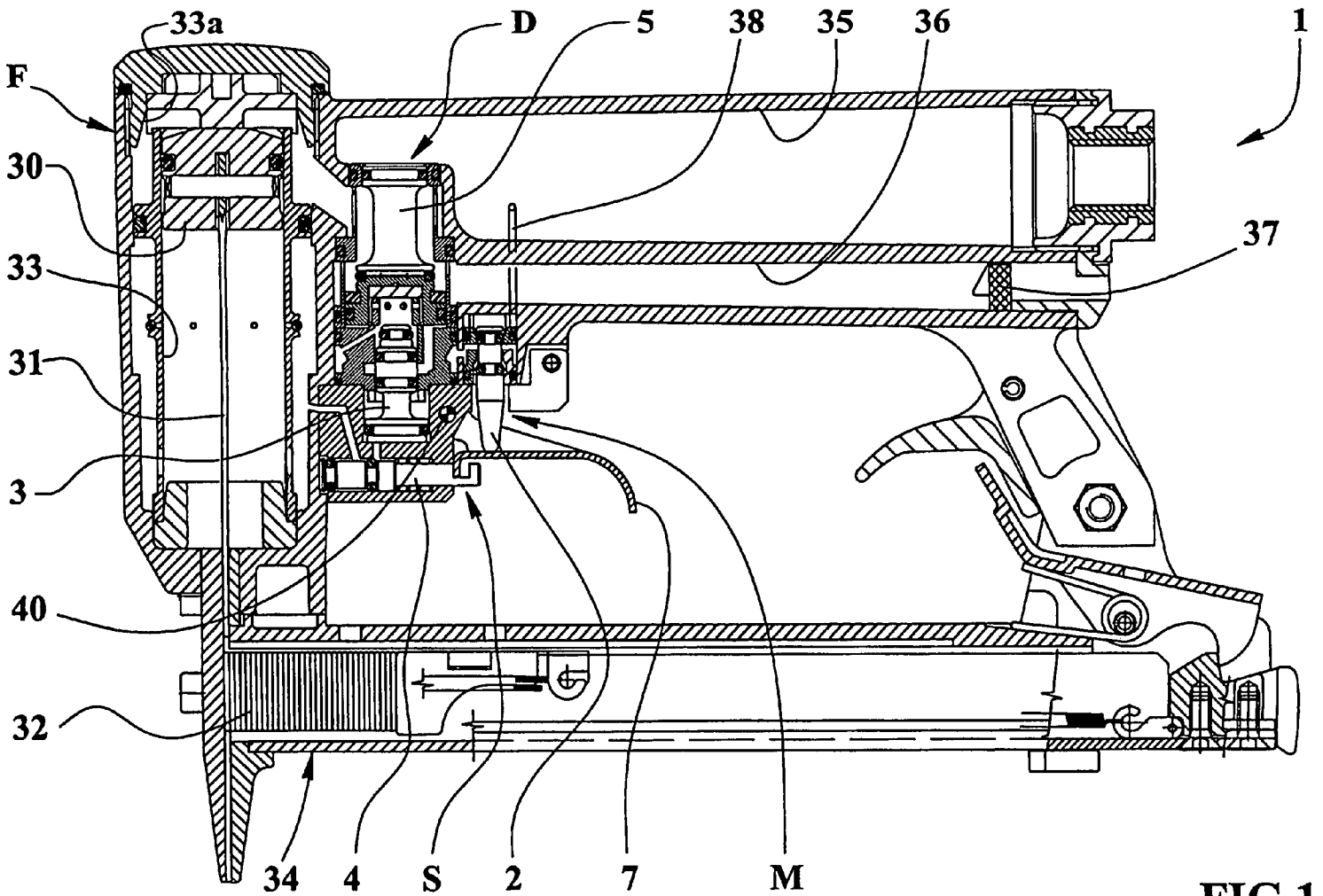
FIG. 1 illustrate a sectional view of the pneumatic stapler machine object of the present invention, in association with a magazine for fixing means, in a non operation condition of the same machine.
Figure 2:
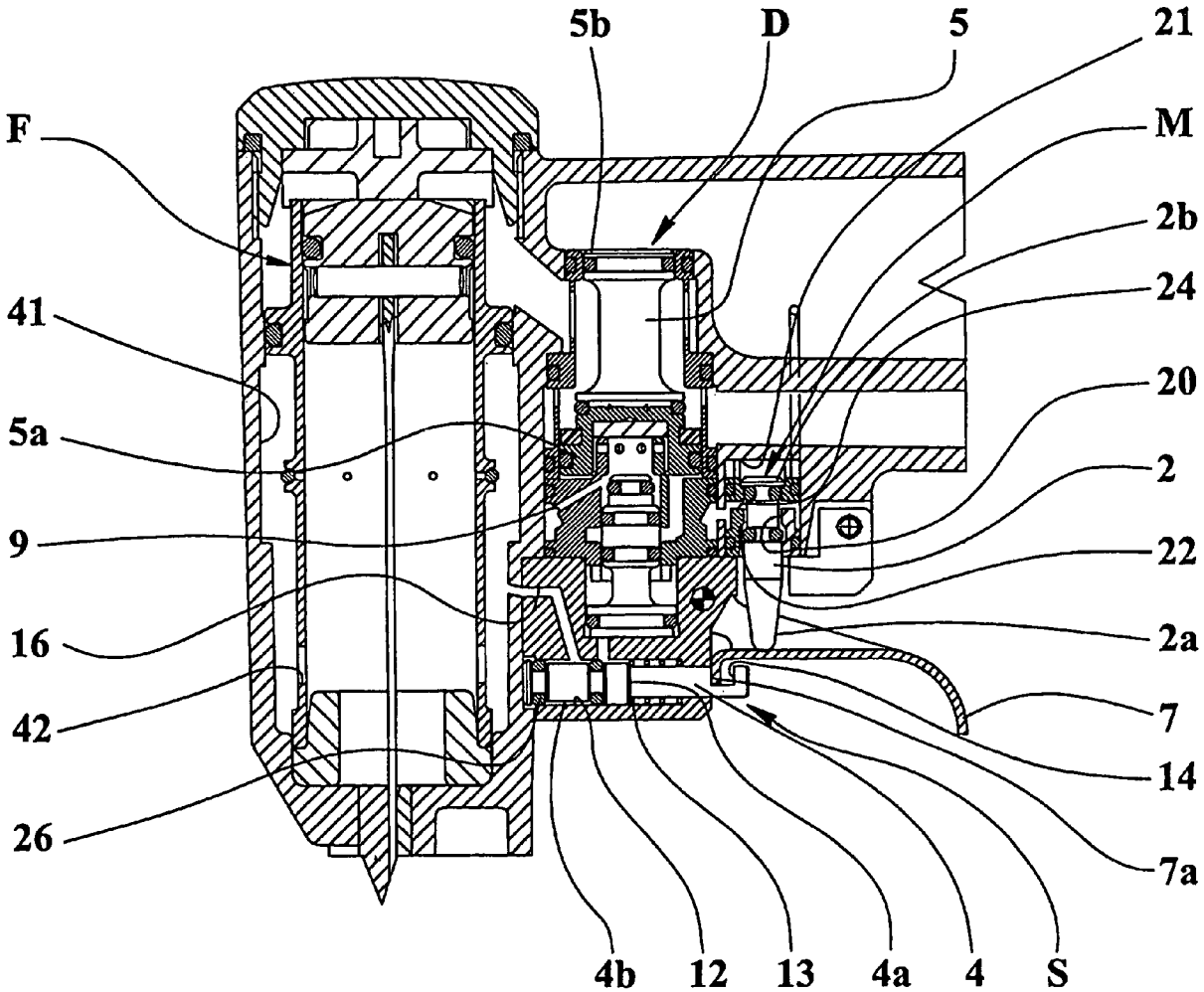
FIG. 2 illustrate a partial enlarged view of FIG. 1.
Figure 3:
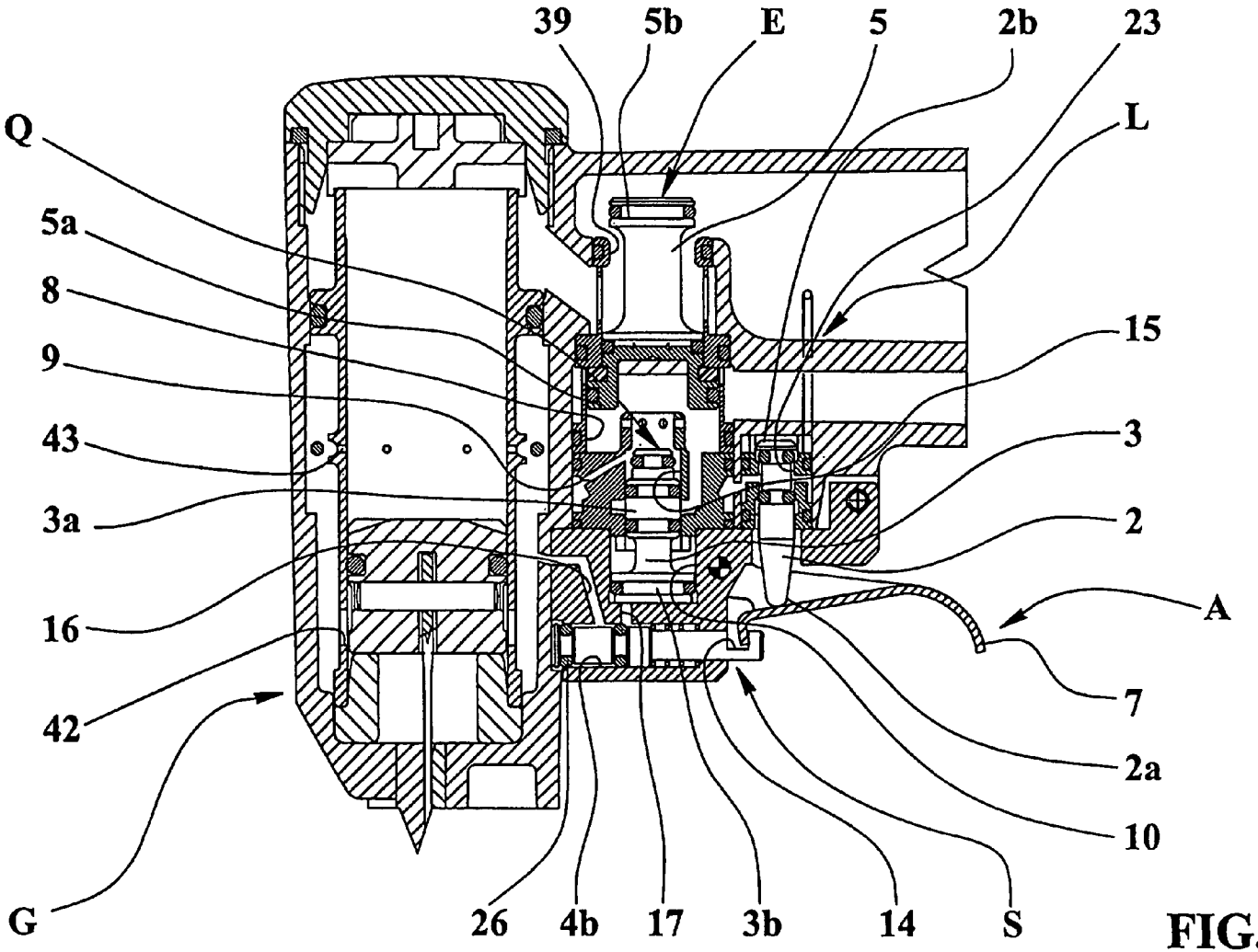
FIG. 3 illustrate a section partial view of FIG. 2 machine in a first activation condition.
Figure 4:
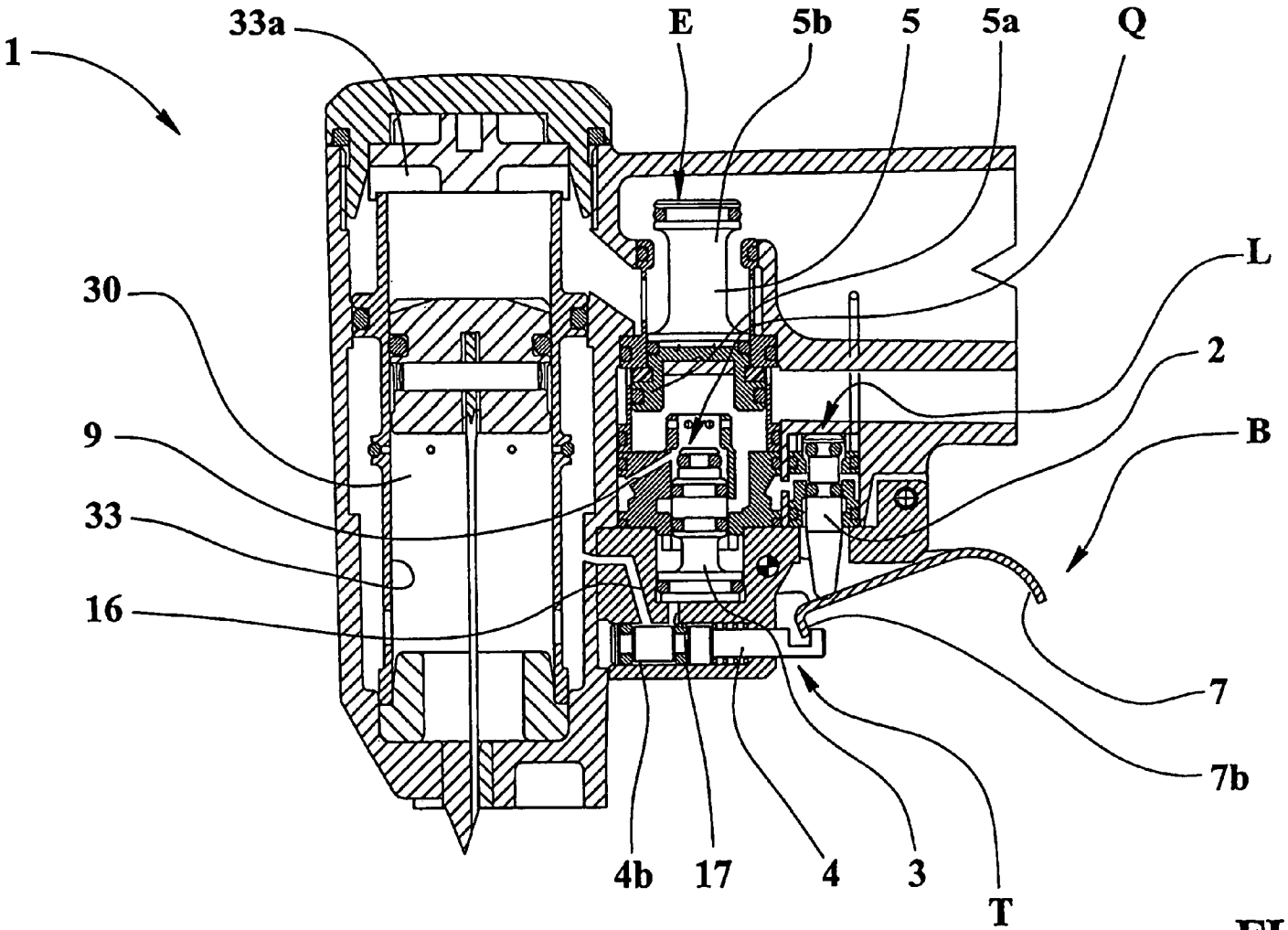
Figure 5:
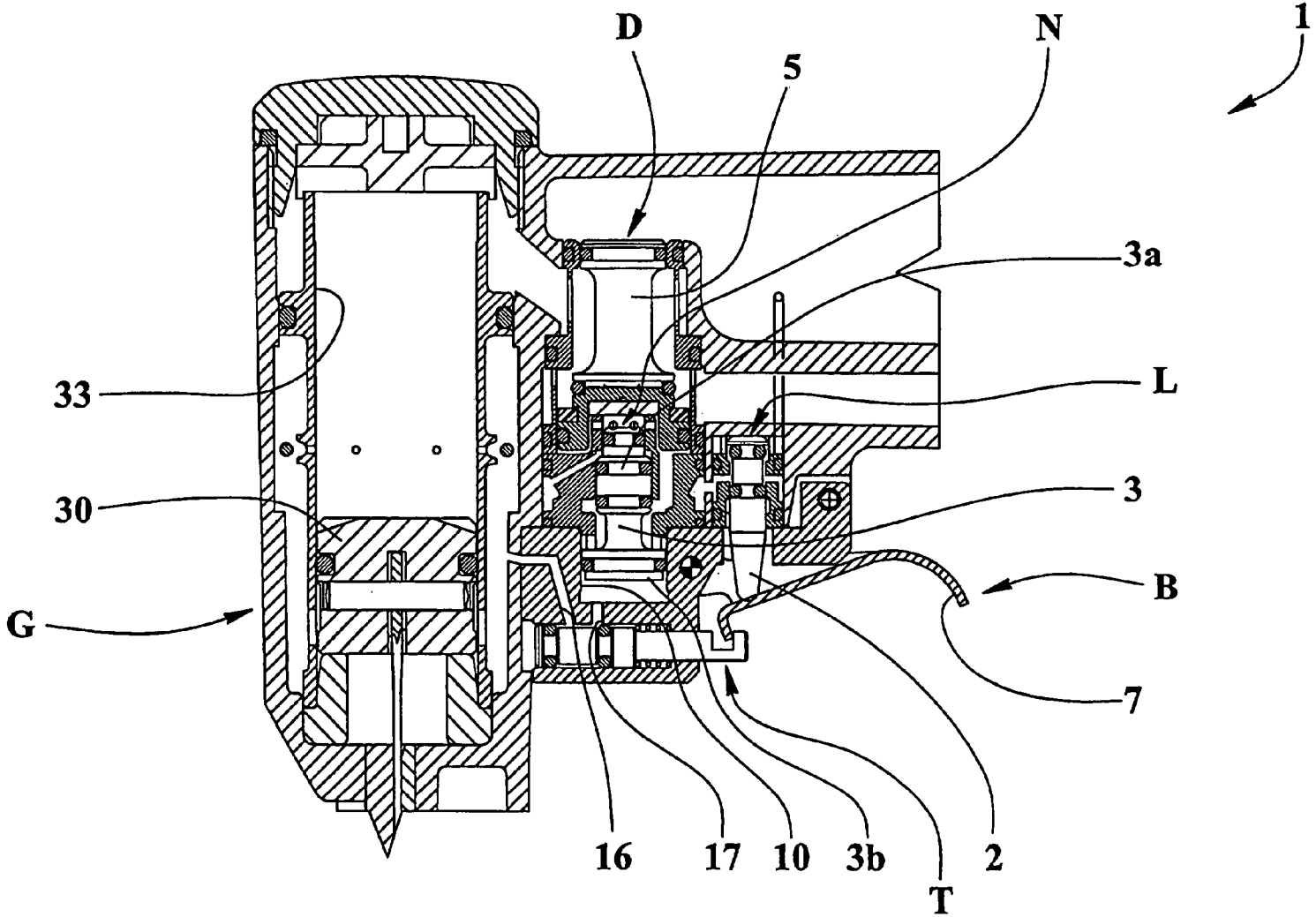
Figure 6:
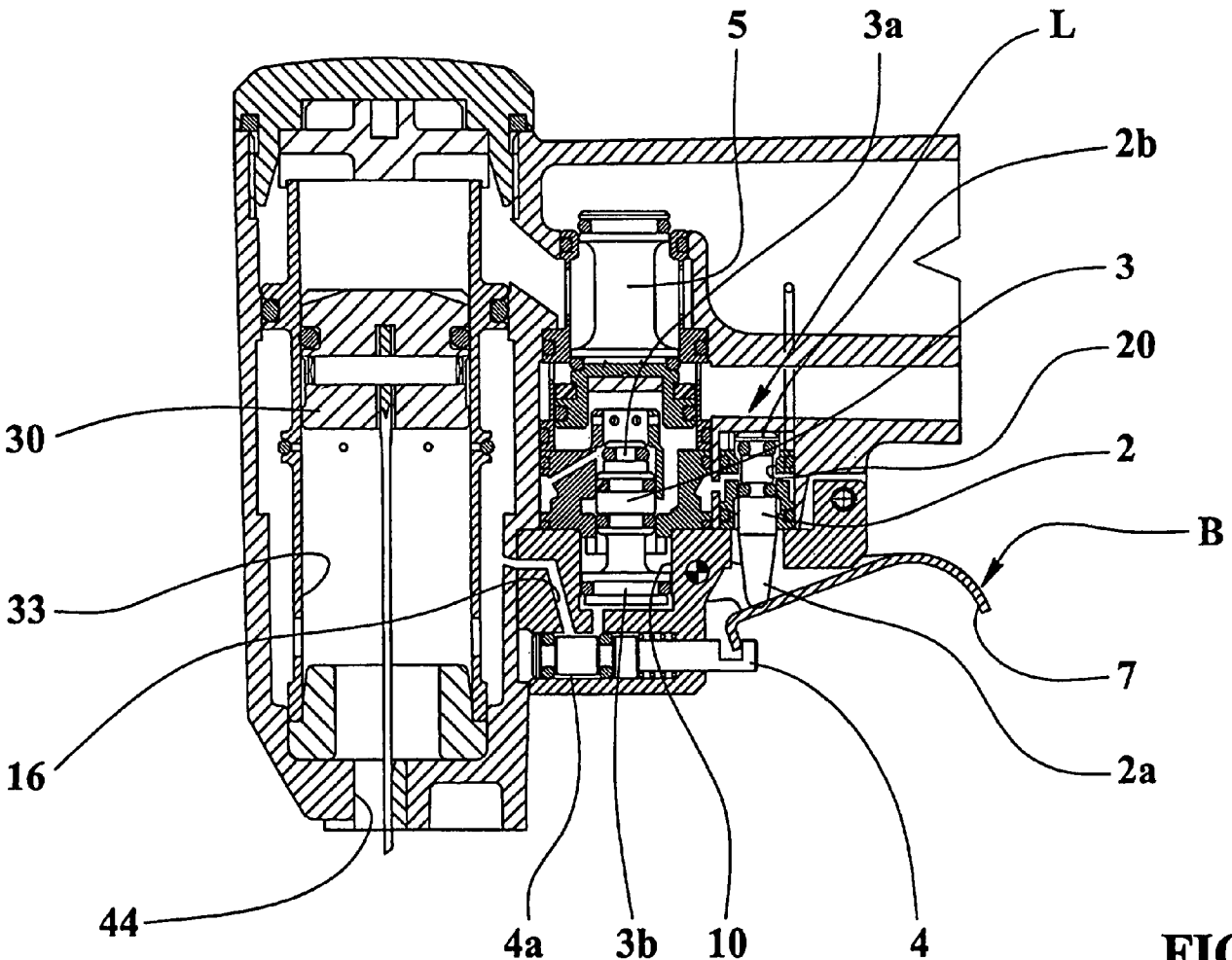

FIGS. from 4 to 6 illustrate partial sectional views of the machine of FIG. 2 in respective and subsequent operation phases, in correspondence of a second activation condition of the machine the same.

BEST MODE OF CARRYING OUT THE INVENTION

With reference to the figures from 1 to 6, with 1 is designed the pneumatic fixing machine, object of the present invention, of the type comprising a piston mean 30, sliding inside a cylinder 33 and supporting a beating blade 31, fit to act on a fixing mean 32, for instance a metallic staple or a pin, contained in a magazine 34 of known type and associated to the machine 1. The piston is actuated and controlled in its motion through first valve means 5, second 2, third 3 and fourth 4 located inside the machine 1.

The first valve means 5 are mobile between two extreme opening E and closing D positions, in correspondence of which they connect in flow communication an inlet portion 33*a* of said cylinder 33 respectively with a feeding of pressurized fluid and with an external outlet.

More precisely, the inlet portion 33*a* can selectively be connected in communication with a feeding room 35 containing pressurized air and connected to an external source of compressed air, such as a compressor or a fixed plant pneumatic network, or with a outlet duct 36, flowing in the external environment through a filter silencer 37.

The second valve means 2 are movable by means of a trigger mean 7 and they are mobile between two extreme positions, of occlusion M and of passage L, in which they connects a base portion 5*a* of the first valve means 5 in flow communication, through a first duct 9, respectively with the feeding of pressure fluid and with an external outlet.

The first valve means 2 substantially consist of a lengthened and shaped element, typically a varying section cylindrical stem, that is sliding housed in a third seat 20, having complementary cylindrical shape, provided with a plurality of openings: a first opening 23, positioned to an upper end of such seat 20, flows in a third room 21, that is in flow connection, through a channel 38, with the feeding room 35; a plurality of second openings 24 on the side walls of the seat 20 and connected to the first duct 9; and a third opening 22, positioned to the opposite extreme of the third seat 20 with respect to the first opening 23, that flows outside, for the air outlet.

The cylindrical stem of the second valve means 2 has an external portion 2*a*, protruding externally in the third seat 20 and fit to match the trigger mean 7 and a lock portion 2*b*, opposite to said external portion 2*a* and fit for closing the first opening 23 of the third seat 20 in the occlusion position M of said first valve means 2.

The third valve means 3 are mobile between an occlusion position N and a crossing position Q, in which they can respectively close or open the flow connection between the duct 9 and the first valve means 5.

The third valve means 3 essentially consist of a shaped stem, typically a cylindrical stem having a ranging section, comprising two end portions, first 3*a* and second 3*b*, respectively sliding housed in a second seat 15 and in a first room 10.

The first end portion 3*a* is shaped to close the exit of the first duct 9 inside the second seat 15 in the occlusion position N of the third valve means 3, while the second end portion 3*b* is subject to the force of the pressurized fluid contained in the first room 10.

The second end portion 15 upwardly flows into a second room 8 in which the base portion 5*a* of the first valve means 5 is sliding housed.

The first valve means 5 include, besides, a closing portion 5*b* fit to cut off the pressurized fluid flow in the closing condition D. In particular, said closing portion 5*b* is able to seal a fourth outlet opening 39 of the feeding room 35. The closing portion 5*b* have an equivalent transversal section smaller than the base portion 5*a*. Similarly, the first end portion 3*a* of the third valve means has an equivalent transversal section smaller than the second end portion 3*b*.

The forth valve means 4 are also operated by the trigger mean 7 and are mobile between a block position S and a transit position T, in which they respectively allows to close or to open the flow connection between the cylinder 33 and the third valve means 3.

The fourth valve means 4 are constituted by a lengthened element and shaped, preferably a cylindrical stem, sliding housed in a first seat 12, having cylindrical complementary shape and in flow connection with the cylinder 30, though at least a second duct 16, and with the first room 10, through a third duct 17.

In the illustrated embodiment, the geometric axis of the valve means second 2 and fourth 4 are mutually perpendicular and the geometric axis of the first 5 and third 3 valve means are nearly coincident and nearly parallel to the axis of the second valve means 2.

The fourth valve means 4 include an hollow 14, carried out in a portion of the cylindrical stem, protruding externally outward the first seat 12, and in which a shaped free end 7*a* of the trigger mean 7 is engaged therein. The shape and the dimensions of the hollow 14 and of the free end 7*a* are fit for the mutual engagement and therefore the translation of the stem, only for a rotation, bigger then a certain angular value, of the trigger 7 that it is pivoting around a pivot 40.

They are provided, besides, elastic means 13, properly sized to exert an elastic strength on the fourth valve means 4 and to maintain them, in absence of external strengths practiced by the trigger mean 7, in the block position S. The elastic means 13 preferably consist of a compression operating helical spring, and housed in the first seat 12 in order to match a bottom wall of this last and a prominence 4*a* of the fourth valve means 4.

The elastic means 13 can be sized for developing an antagonist strength of desired intensity, depending on the specific user requirements, for instance to make the second part of the rotation of the trigger mean 7 more tenacious and therefore mostly perceptible.

The fourth valve means 4 include, besides, an hollow 4*b*, essentially constituted by a portion of the cylindrical stem, having a reduced diameter with respect to the first seat 12 and delimited by a couple of ring fingers 26, typically "Or-ring" gaskets, said hollow 4*b* being provided to connect in flow communication the second 16 and third 17 ducts in the transit position T of said fourth valve means 4.

The operation of the pneumatic fixing machine 1, object of the present invention, provides that in a first activation condition A of the same, the trigger mean 7 is partially pressed, in order to move the second valve means 2 from the occlusion position M, in which they are maintained by the pressure of the fluid present in the third room 21, to the passage position L, in which they allows the compressed air to reach to the second room 8 an act on the base portion 5*a*, having bigger equivalent transversal section in respect to that of the closing portion 5*b*, in order to push the first valve means 5 in the opening position E.

In this way, through the fourth opening 39 of the feeding room 35, the pressurized air reaches the inlet portion 33*a* of the cylinder 33 strongly pushing the piston mean 30 from an inside position F to an external position G, in which the beating blade 31 hammers the fixing mean 32 in the part to be fixed.

The release of the trigger mean 7 determines the return of the second valve means 2 in the occlusion position M, with the consequent closing of the first opening 23 and the unloading, through the third opening 22, of the third seat 20 and, through the first duct 9, of the second room 8. This determines the return of the first valve means 5 in the closing position D, with the interruption of the feeding of the compressed air to the piston mean 30. The return of this last in the upper initial position F is ensured by the expansion of the compressed air, contained in a saving ring room 41 of known type, that it expands in the cylinder 30 through first side openings 42. The entry of the compressed air in the saving ring room 41 occurs through second side openings 43, during the stroke of the piston mean 30.

In a second activation condition B of the machine 1, the trigger mean 7 is further completely pressed up to transfer the fourth valve means 4 from the halt position S to the transit position T, exceeding the antagonist elastic strength of the elastic means 13.

In this position, when the piston mean 30 comes in the external position G, in accord with the above described operational sequence, the compressed air, that fills the saving ring room 41, can reach the first room 10, crossing in sequence the second duct 16, the hollow 4*b* of the fourth valve means 4 and the third duct 17.

In the room 10 the compressed air acts on the second end portion 3*b* having equivalent transversal section bigger than that of the first portion 3*a*, in order to push the third valve means 3 from the crossing position Q to the occlusion position N, in order to cut off the pressurized air flow coming from the duct 9 and direct to the second room 8.

The lack of compressed air in said room 8 determines the return of the first valve means 5 in the closing position D or the interruption of the compressed air feeding to the piston mean 30.

Also in this case the return of this last in the inside superior initial position F is realized by the expansion of the compressed air, contained in the saving ring room 41 of known type, that it expands in the cylinder 30 and subsequently it flows through opportune outlet 44 to the outside. At this step, the cylinder 30, the saving ring room 41 and consequently the second duct 16, the hollow 4*b*, the third duct 17 and the first room 10 are at atmospheric pressure.

Since the trigger mean 7 is still pressed and maintain the second valve means 2 in the passage position L, the compressed air is free to reach the second seat 15, causing the moving of the third valve means 3 in the crossing position Q and subsequently, reaching to the second room 8, the moving of the first valve 5 in the opening position E for a new stroke of the piston mean 30.

The cycle automatically repeats as above explained up to the release of the trigger mean 7 allowing the machine 1 to perform repeated hits, with a frequency or adjustable frequency controllable by regulation means of compressed air flow, of known type and not illustrated.

An advantage of the present invention is to provide a pneumatic fixing machine to indifferently operate in single hit or automatic repeated hits modality, endowed with a compact structure and relatively simple, with a small number of components, therefore economic to be made and assembled.

Other advantage is to provide a sure and reliable operation machine, that is also simple to be used by an unskilled operator, and reducing to the minimum the risk of an unintentional actuating of the automatic modality.

Further advantage consists in providing a fixing machine that allows the operator a firm and sure handling, right and comfortable from the ergonomic point of view.

The invention claimed is:

1. A pneumatic fixing machine comprising:

a piston means (30) slidably located inside a cylinder (33);

first valve means (5) movable between two extreme positions, an opening position (E), such that the first valve means are in fluidic communication with an inlet portion (33*a*) of said cylinder (33) for receiving a pressurized fluid and a closing position (D) where the first valve means are in communication with an external outlet;

second valve means (2) movable in response to operation of a trigger (7), the second valve means movable between an occlusion position (M) for fluidly connecting at least a first duct (9) and a base portion (5*a*) of the first valve means (5) for feeding the pressurized fluid therethrough, and, a passage position (L) for connecting to an external outlet;

third valve means (3) movable between a position of obstruction (N), to cut off flow between the first duct (9) and the first valve means (5), and, a crossing position (Q), which opens a flow connection between the duct (9) and the first valve means (5);

fourth valve means (4) movable in response to operation of the trigger (7), the fourth valve means movable between a block position (S), where flow is obstructed between the cylinder (33) and the third valve means (3), and, a transit position (T) such that flow is permitted between the cylinder (33) and the third valve means (3);

the fourth valve means (4) being a lengthened and shaped element, slidably housed inside a first seat (12) which is complementary shaped and in fluid communication with the cylinder (30) through a second duct (16), the lengthened and shaped element protruding externally from the first seat (12), and having an element portion engageable by the trigger; and, elastic means (13) for exerting a biasing force on the fourth valve means (4) to bias the fourth means towards the block position (S), in absence of operation of the trigger (7);

wherein in a first activation condition (A), the trigger (7) is partially pressed, positioning the second valve means (2) in the passage position (L), to allow the pressurized fluid to push the first valve means (5) into the opening position (L), actuating the piston means (30);

and wherein in a second activation condition (B), the trigger (7) is further and completely pressed only after overcoming the biasing force of the elastic means (13) to give a tactile feel when the trigger engages the element portion and displaces the element, moving the fourth valve means (4) into the transit position (T), to allow the pressurized fluid coming from the cylinder (33) to move the third valve means (3) into the occlusion position (N), causing the return of the first valve means (5) to the closing position (D) and the consequent return of the piston means (30) to the initial position (F).

2. The pneumatic fixing machine according to claim 1 wherein the fourth valve means (4) has a hollowed portion (14) for receiving a shaped free end (7*a*) of the trigger (7).

3. The pneumatic machine according to claim 1 wherein the elastic means (13) comprise a compression spring received in the first seat (12) and on a prominence (4*a*) of the fourth valve means (4).

4. The pneumatic machine according to claim 1 wherein the third valve means (3) comprise a shaped stem having a first end portion (3*a*) slidably housed in a second seat (15) and a second end portion (3*b*) slidably housed in a first room (10), the first end portion (3*a*) being shaped to occlude the exit of the first duct (9) inside the second seat (15) when the third valve means are in the occlusion position (N).

5. The pneumatic machine according to claim 4 wherein the second end portion (3*b*) has an equivalent transversal section greater than an equivalent transversal section of the first end portion (3*a*).

6. The pneumatic machine according to claim 4 further comprising a third duct (17) for fluid communication between the first seat (12) and the first room (10).

7. The pneumatic machine according to claim 6 wherein the fourth valve means:

(4) has a hollowed portion (4*b*) for fluid communication between the second duct (16) and the third duct (17) when the fourth valve means are in the transit position (T).

8. The pneumatic machine according to claim 4 wherein the base portion (5*a*) of the first valve means (5) is slidably housed in a second room (8) which is in fluid communication with the second seat (15).

9. The pneumatic machine according to claim 4 wherein the first valve means (5) comprise a lengthened and shaped element, slidably housed inside a third seat (20) which has a first opening (23) for fluid communication with a third room (21) that it is in fluid communication with the feed of pressurized fluid, a second opening (24) intermediately located and connected to the first duct (9) and a third opening (22) for connecting with the external outlet.

10. The pneumatic machine according to claim 9 wherein the first valve means (5) has an external portion (2*a*), fit to match the trigger (7), and a lock portion (2*b*), opposite to said external portion (2*a*) and fit for closing the first opening (23) of the third seat (20) when the first valve means are in the occlusion position (M).

11. The pneumatic machine according to claim 1 further comprising a third duct (17) for fluid communication between the first seat (12) and the first room (10).

12. The pneumatic machine according to claim 11 wherein the fourth valve means:

(4) has a hollowed portion (4*b*) for fluid communication between the second duct (16) and the third duct (17) when the fourth valve means are in the transit position (T).

13. The pneumatic machine according to claim 1 wherein the first valve means (5) has a closing portion (5*b*) shaped to cut off pressurized fluid flow when the first valve means are in the closing condition (D), said closing portion (5*b*) having a smaller equivalent transversal section than an equivalent transversal section of the base portion (5*a*).

14. The pneumatic machine according to claim 1 wherein a geometric axis of the second valve means (2) and of the fourth valve means (4) are mutually perpendicular.

15. The pneumatic machine according to claim 1 wherein a geometric axis of the first valve means (5) and of the third valve means (3) are nearly coincident and nearly parallel to an axis of the second valve means (2).

* * * * *